US008235087B2

(12) United States Patent
Svenson

(10) Patent No.: US 8,235,087 B2
(45) Date of Patent: Aug. 7, 2012

(54) ROLL-UP CLOSURE

(76) Inventor: Mike Svenson, Cornwall (CA)

( * ) Notice: Subject to any disclaimer, the term of this patent is extended or adjusted under 35 U.S.C. 154(b) by 0 days.

(21) Appl. No.: 12/930,988

(22) Filed: Jan. 21, 2011

(65) Prior Publication Data

US 2011/0120965 A1 May 26, 2011

Related U.S. Application Data

(62) Division of application No. 12/386,553, filed on Apr. 20, 2009, now Pat. No. 7,886,805.

(30) Foreign Application Priority Data

Apr. 24, 2008 (CA) ..... 2629679

(51) Int. Cl.
*E06B 9/08* (2006.01)

(52) U.S. Cl. ..... 160/133; 160/DIG. 15

(58) Field of Classification Search ..... 160/133, 160/235, DIG. 15
See application file for complete search history.

(56) References Cited

U.S. PATENT DOCUMENTS

| | | | | |
|---|---|---|---|---|
| 1,081,202 | A | 12/1913 | Brunst | |
| 2,894,572 | A | 7/1959 | Nelson | |
| 5,275,223 | A * | 1/1994 | Magro et al. | 160/191 |
| 5,443,107 | A | 8/1995 | Kraler | |
| 7,886,805 | B2 * | 2/2011 | Svenson | 160/315 |

* cited by examiner

*Primary Examiner* — Blair M. Johnson

(57) ABSTRACT

A drum for a roll-up closure, the closure having a door of hinged together slats, one end of the door adapted to be mounted on the drum, the door adapted to be wound on the drum as the drum is rotated. The drum has a wall defining its shape with a depression in the wall extending both inwardly and across the width of the drum. The cross-section of the wall defines an increasing spiral from one side of the depression to the other side of the depression. An extension of the wall extends from the one side of the depression towards the other side to partially close the depression. The partially closed depression is shaped to receive the one end of the door to mount the door on the drum.

1 Claim, 4 Drawing Sheets

ROLL-UP CLOSURE

RELATED APPLICATIONS

This application is a divisional application of application Ser. No. 12/386,553, filed Apr. 20, 2009. This application is hereby incorporated inthis application by reference.

BACKGROUND OF THE INVENTION

1. Technical Field

This invention is directed toward improvements in roll-up closures. This invention is more particularly directed toward a tensioning unit for tensioning the spring in a roll-up closure. The invention is also more particularly directed toward the drum for carrying the hinged door on the closure.

2. Background Art

Roll-up closures are mounted over the opening to be closed by the hinged door of the closure. The closure has an axle which is normally fixedly mounted between end plates fastened to the wall of a building framing the opening. A drum is rotatably mounted on the axle. A hinged door is attached at its top end to the drum and wound up on the drum when the drum is rotated to open the opening. A motor is normally mounted on the axle within the drum to rotate the drum. However the motor could be mounted outside the drum at one end or the drum could also be rotated manually. A tension coil spring is mounted on the axle within the drum with one end of the spring connected to the axle and the other end connected to the drum. The spring is normally initially tensioned when the closure is installed and is further tensioned when the opening is closed by the hinged door, the door unwinding off the drum. The tensioned spring makes it easier for the door to move up when opening the opening. The tension in the spring can be adjusted externally by various known tensioning means.

The known closures have several disadvantages however. The tensioning means employed to adjust the tension in the spring is often mounted outside the end plates making it difficult to employ the closure in tight places. The tensioning means also are quite complicated to use, some requiring two people, some requiring a precarious perch on a ladder. The drum normally employed is cylindrical making it difficult to smoothly roll the hinged door onto the drum. It is also difficult to position and mount elements, such as the drive motor, within the drum.

SUMMARY OF THE INVENTION

It is the purpose of the present invention to provide a roll-up closure having an improved tensioning unit. The tensioning unit is simple in construction and quite compact and can be mounted within the end plates allowing the closure to be installed in tight places. The unit is also quite easy to assemble and can be easily and safely used by one person on the ground. It is another purpose of the present invention to provide a drum for a roll-up closure which easily and securely allows the hinged door of the closure to be connected to it; which more evenly wraps the hinged door thereon; and which makes it easier to mount elements within the drum.

In accordance with the present invention there is provided a tensioning unit comprising a ratchet wheel fixedly mounted on the axle, the axle normally rotatable on the end plates. The ratchet wheel is adjacent one of the end plates and a stop member, slidably mounted on the one end plate, cooperates with the ratchet wheel to lock it, and thus the axle, against rotation in a direction that reduces tension in the spring. A lever is movably mounted on the axle between the ratchet wheel and the end plate. The lever is movable radially to allow it to selectively connect with the ratchet wheel and is also rotatable on the axle to allow it to rotate the wheel in one direction when connected to it. Rotation of the ratchet wheel in the one direction will rotate the axle and thus the one end of the spring to tighten it. The stop allows the wheel to rotate in the tightening direction but prevents the wheel and axle from rotating in the opposite direction to loosen the spring and reduce tension when the lever is disconnected from the wheel.

Also in accordance with the present invention there is provided a drum for the closure comprising an extruded tube with a mounting for the one end of the hinged door on its surface. The mounting comprises a shallow depression in the wall, formed from the outside of the drum, the depression extending across the width of the drum parallel to its longitudinal axis. The depression has a hook-shaped end to snugly receive the male hinge element on the free side of the first slat in the hinged door. The mounting includes a support surface for part of the first slat adjacent the male hinge element, the surface extending tangentially from the depression. The tube, seen in cross-section, has the wall generally follow a spiral curve from the support surface on one side of the depression to the other side of the depression, the radial distance of the wall from the center of the tube gradually increasing the farther away from the support surface that you go. The shape makes it easier to wind the door thereon. The tube also has extruded channels on its inner surface, extending across the tube parallel to the longitudinal axis of the tube, to help slidingly mount elements within the tube. The channels make it easier to longitudinally position the elements within the tube while preventing them from rotating within the tube.

The invention is particularly directed toward a spring tensioning unit for a roll-up closure. The closure has a pair of end plates; an axle rotatably mounted between and on the end plates; a drum for carrying a closure, the drum rotatably mounted on the axle; and a tensioning coil spring mounted on the axle and connected between the axle and the drum. The tensioning unit has a ratchet wheel fixedly mounted on the axle adjacent one end plate, the wheel having spaced-apart teeth on its periphery. A stop member is slidably mounted on the one end plate with a stop tab cooperating with the teeth on the wheel to stop movement of the wheel in a direction reducing tension on the spring. A lever is mounted between the wheel and the end plate, the lever having a lever tab for cooperating with the wheel. The lever is movable on the axle both radially and rotationaly to position the lever tab against a tooth and to then rotate the tooth, and the axle, in a direction to increase tension on the spring.

The invention is also directed toward a hollow drum for a roll-up closure that is extruded and which has at least two apart channels on the inner surface of its wall opening radially inwardly, the channels slidably receivng elements to be mounted within the drum while preventing their rotation.

The invention is further directed toward a hollow, extruded, drum for a roll-up closure. The drum has a shallow depression formed in the wall, the depression extending inwardly and extending across the width of the drum. There is an overhang extending partway over the depression from one side of the depression, the one side of the depression being curved to match the curve of one side of a male hinge member on one side of a slat of a door to be wound on the drum. The overhang and the curved side imitate the curved open side of the female hinge member on the other side of the slat.

DETAILED DESCRIPTION OF THE INVENTION

Figure 1:
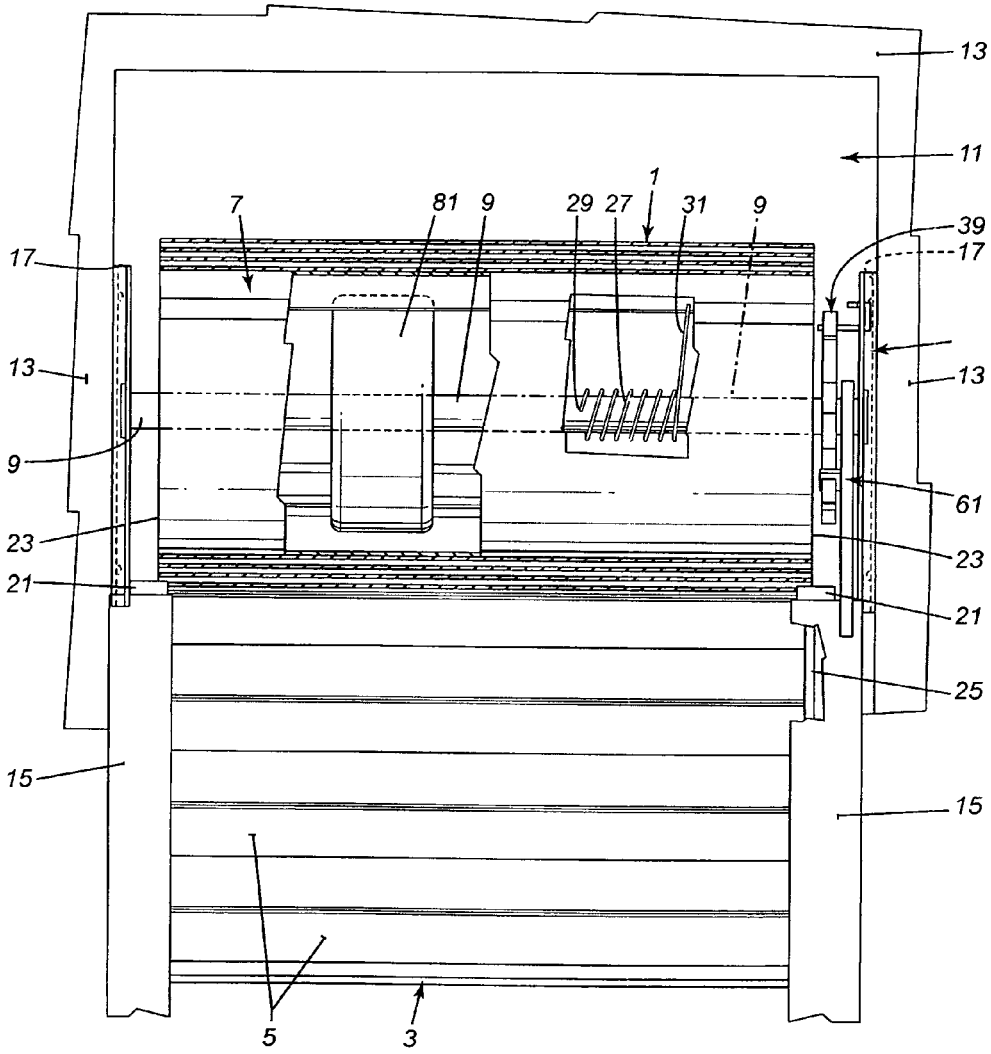
FIG. 1 is a partial front view, in partial section, of a roll-up closure.
Figure 2:
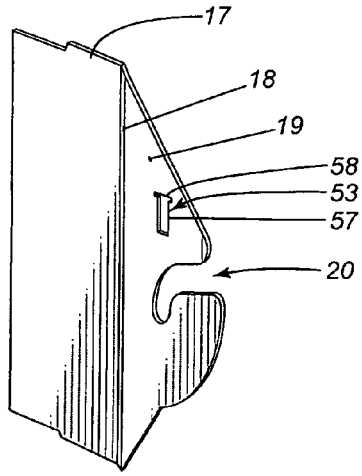
FIG. 2 is a perspective view of an end plate.

The rolling closure 1, as shown in FIGS. 1 and 2, includes a hinged door 3 made from a plurality of hinged slats 5 wound on a drum 7 rotatably mounted an axle 9. The closure 1 is mounted at the top of an opening 11 in a wall 13. Side frames 15 are mounted on each side of the opening 11 on the wall 13 and an end plate 17 is mounted on top of each frame 15. The end plate 17 is offset, as shown at 18 in FIG. 2, to have a portion 19 spaced a short distance from the side of the opening. The axle 9 is rotatably mounted in slots 20 in the off set portion 19 of the end plates 17 to extend between the plates. A guide 21 on top of each frame 15 guides the side 23 of the hinged door 3 into an inside groove 25 running the length of the frame 15.

To control the movement of the door 3 a tension coil spring 27 is normally mounted over the axle 9 within the drum 7 with one end 29 of the spring mounted on the axle 9 and the other end 31 mounted to the drum 7. The tension of the spring 27 is adjusted during installation so that the spring winds up during movement of the hinged door 3 off the drum 7 to close the opening making it easier to raise the door during opening of the opening 11.

Figure 4:
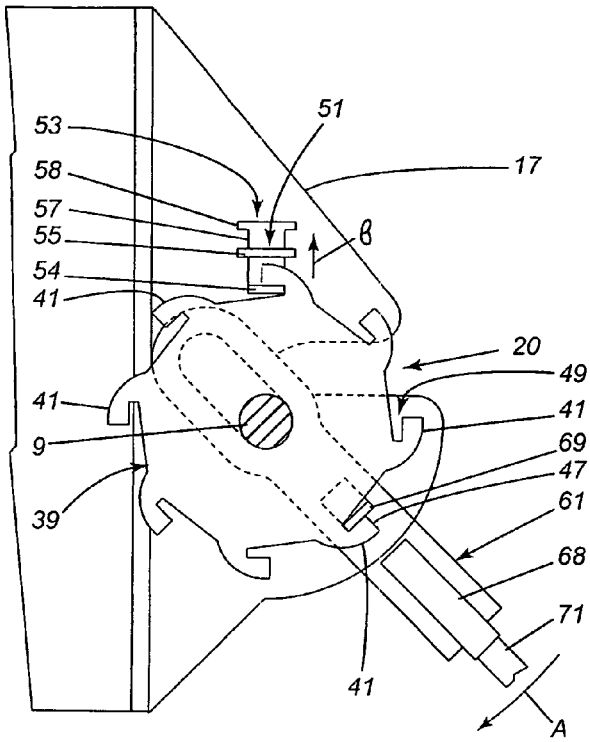
FIG. 4 is a perspective view of the tensioning unit.
Figure 5:
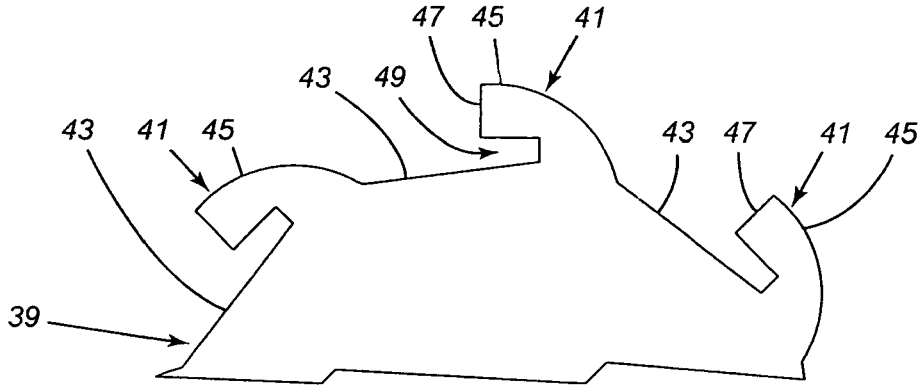
FIG. 5 is a detail front view of the ratchet wheel.
Figure 3:
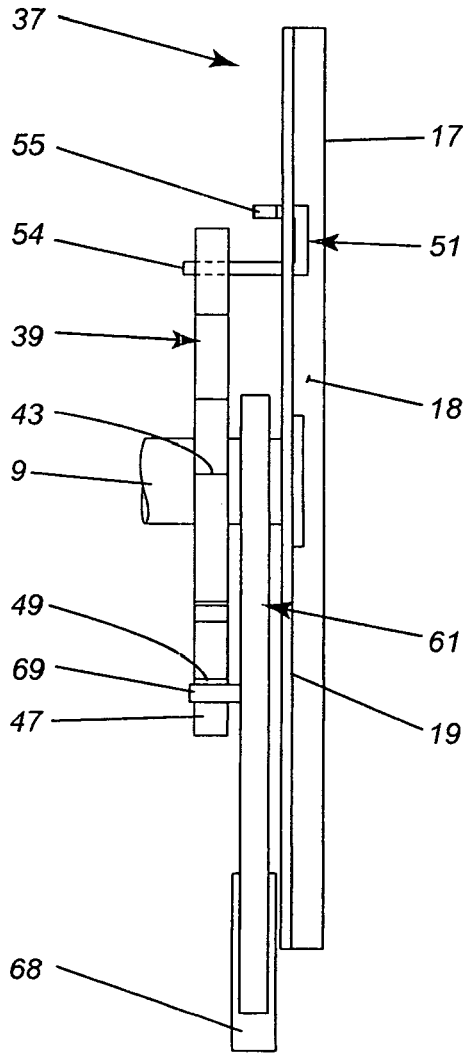
FIG. 3 is a detail front view of the tensioning unit.

A tensioning unit 37 is employed to be able to adjust the tension of the spring 27. The tensioning unit 37, as shown in FIG. 3, has a ratchet wheel 39 fixedly mounted on the axle 9 adjacent the inside of the end plate 17. The ratchet wheel 39 has uniformly spaced-apart teeth 41 about its periphery as shown in FIGS. 4 and 5. Each tooth 41 has an initial straight surface portion 43 leading from the previous tooth to a curved surface portion 45 moving radially away from the center of the wheel 39 and terminating in a stop edge 47 that extends radially inwardly to the start of the straight surface portion 43 of the next adjacent tooth. There is slot 49 extending into the tooth from the bottom of the stop edge 43, the bottom of the slot 49 aligned with the straight surface portion 43 of the next tooth.

Figure 6:
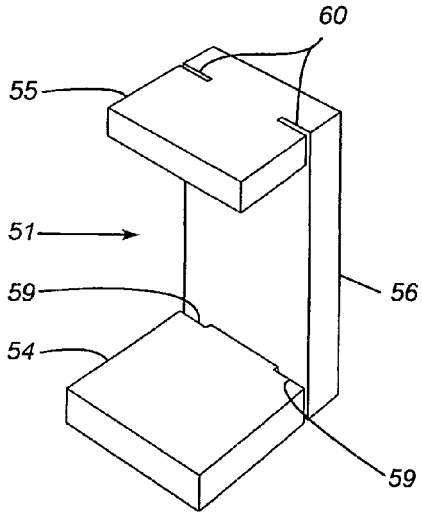
FIG. 6 is a perspective view of the stop.

The tensioning unit 37 includes a stop member 51. The end plate 17 mounts a stop member 51 in a vertical, T-shaped, slot 53, the stop freely movable vertically in the slot 53. The stop 51, as shown in FIG. 6, has a laterally projecting tab 54 that normally interferes with a stop edge 47 on a tooth 41 on the ratchet wheel 39 when the stop 51 is at the bottom of the slot 53. The stop tab 54 enters the slot 49 on the tooth 41. The stop tab 54 prevents the wheel 39, and thus the axle 9, from rotating counter clockwise, when viewing the wheel from the drum side, and thus unwinding the spring 27 while it is tensioned. The stop 51 has an upper tab 55 above the stop tab 54, both tabs joined by a back plate 56. The tab 55 is shorter than the stop tab 54. The tabs 54, 55 are wider than the stem 57 of the slot 53, almost as wide as the cross-bar 58 of the slot 53. Both tabs 54, 55 have groves 59, 60 in their sides intermediate their ends for receiving the end plate 17 to retain the stop slidably on the end wall. The stop 51 is mounted in the slot 53 by inserting the stop tab 54 through the cross-bar portion 58 of the slot 53 until its grooves 59 are aligned with the end plate 17 and then dropping onto the end plate to slide down the stem 57 of the slot 53. There is a little play between the grooves 59 and the end plate 17 allowing the stop to be slid down the stem with the upper tab 55 adjacent the outside surface of the end plate 17. Once the upper tab 55 reaches the cross-bar portion 58, it is passed through it to align its grooves 60 with the end plate 17 and then the stop 51 is further dropped down to have the end plate 17 running through both tabs 54, 55 to retain the stop slidably within the slot 53.

Figure 7:
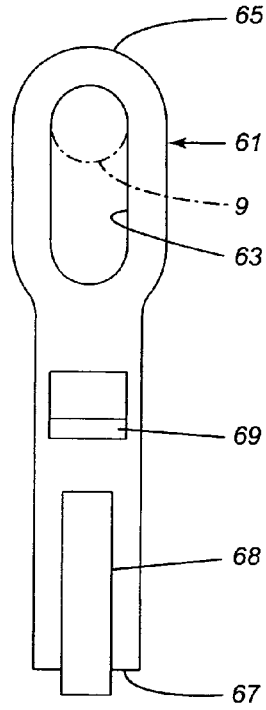
FIG. 7 is a front view of the lever.

The tensioning unit 37 further includes an elongated lever 61, as shown in FIG. 7, mounted loosely on the axle 9 between the ratchet wheel 38 and end plate 17. The lever 61 is in the form of a narrow plate and has an elongated slot 63 adjacent one end 65 through which the axle 9 passes. The slot 63 allows the lever 61 to rotate about the axle 9 and also to move radially with respect to the axle 9. The other end 67 of the lever 61 carries a tubular receiver 68. The lever 61 has a laterally projecting tab 69 bent out from about the middle of the lever intermediate its ends 65, 67. The lever tab 69 is located so it can be abutted against the stop edge 45 of one of the teeth 41 on the ratchet wheel 39 when the lever 61 is manipulated by an operator, and more particularly, so it can enter the slot 49 at the bottom of the stop edge 45.

In use, when the spring 27 is to be tensioned, an elongated rod 71, or the like, is inserted by an operator into the receiver 68 on the lever 61, the lever normally hanging down from the axle 9. The rod 71 is used to manipulate the lever 61 on the axle 9 by rotating it and moving it radially so the lever tab 69 carried by it rests in the slot 49 in the stop edge 47 of a selected tooth 41 on the ratchet wheel 39. The operator then rotates the lever 61 clockwise, as shown by the arrow 'A' in FIG. 4, about the axle 9 while keeping the tab 69 abutted against the stop edge 47, and in the slot 49, to rotate the ratchet wheel clockwise to tighten the spring 27. As the ratchet wheel 39 rotates, so does the axle 9, tightening the spring against the inertia of the drum 7 and the hinged door 3 on it. The rotation of the ratchet wheel 39 also causes the stop member 51 to ride up the curved part 45 of the next tooth adjacent to it, as shown by the arrow 'B', until the stop 51 reaches and passes the stop edge 47 of the tooth to drop down and locate its stop tab 54 in slot 49 in the stop edge 47 of the tooth. The stem 57 of the slot 53 is high enough to prevent the top tab 55 from normally reaching the cross-bar 58 as the stop 51 rises. Having the stop tab 54 in the slot 49 prevents the spring 27 from unwinding and allows the operator to disengage the lever 61 from the tooth it initially engaged with and move it back to the next adjacent tooth to repeat the process if needed.

If the tension in the spring 27 needs to be reduced, the operator can slightly rotate the ratchet wheel 39 with the lever 61 to withdraw the stop tab 54 from the slot 49 in the tooth and then merely push the stop 51 upwardly with another bar to have it clear the stop edge 45. The operator then releases the lever 61 allowing the ratchet wheel 39 to rotate counter clockwise one tooth while simultaneously releasing the stop 51 to drop to engage the next tooth, to reduce tension in the spring.

The tensioning unit is compact allowing it to be mounted inside the end plate and still clear of the hinged door. With the unit between the end plates, the closure can be mounted in tight places with at least one of the end plates tight in a wall corner if needed. The unit is easy to use. Only one person is required to tension the spring and the tensioning can be done from the ground. Having the lever 61 located between the end plate and the ratchet wheel causes it to act as a washer reducing wear between the ratchet wheel 39 and the end plate 17.

Figure 8:
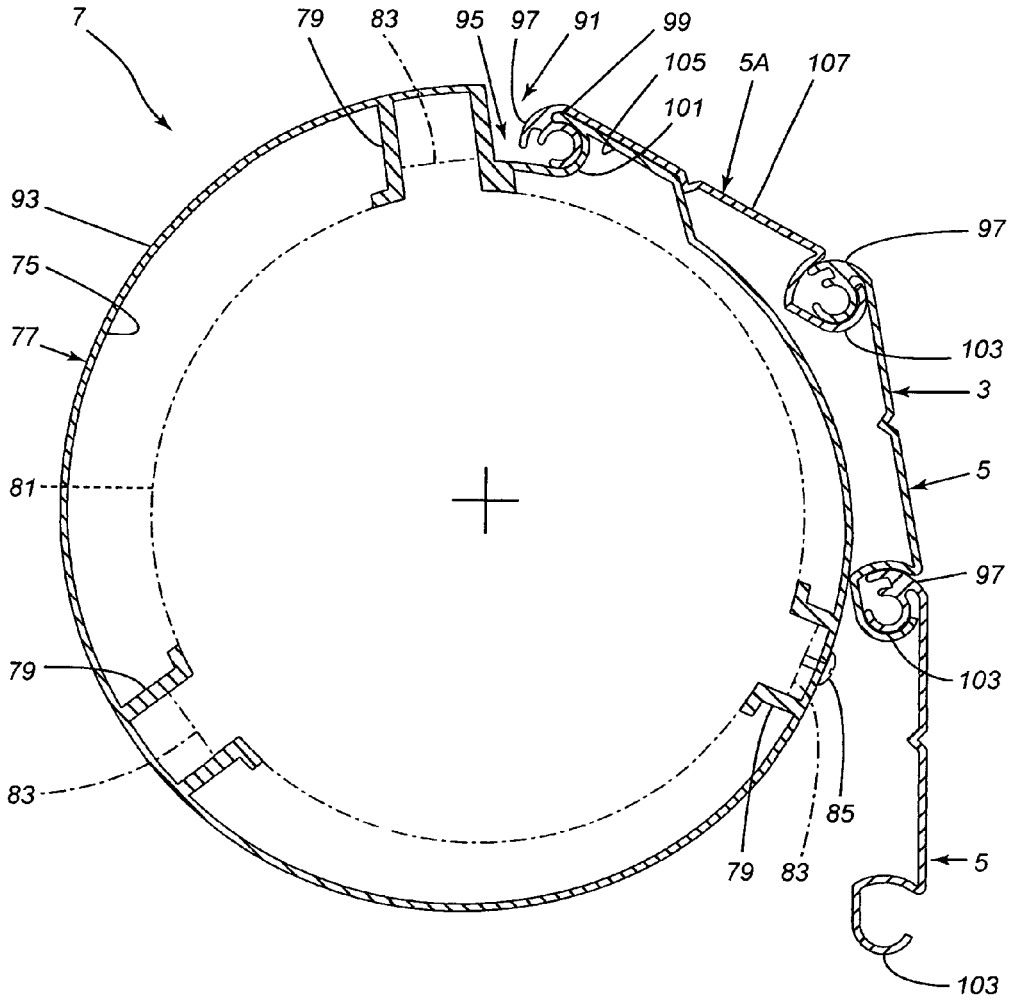
FIG. 8 is a cross-section view of the tube.

The drum 7 for supporting the closure can be constructed to mount elements such as the motor in if more easily. To this end the drum 7 is extruded with the inner surface 75 of the wall 77 of the drum provided with mounting channels 79 at spaced-apart locations along the length of the drum as shown in FIG. 8. Three channels are shown but two or four could be provided. The elements to be mounted within the drum, such as a motor 81, have projecting tabs 83 about their circumference allowing the element to be slid into the drum with the tabs 83 entering the channels 79 to keep the element from rotating within the drum. The element can be slid into the drum the required distance guided by the channels and then locked in place by one or more screws 85 passed through the wall 77 of the drum into one of the channels 79 and the tab 83 in the channel.

The drum 7 also has mounting means 91 on the outer surface 93 of the wall 77 for mounting the hinged door thereon more easily. The mounting means 91 has a shallow depression 95 formed in the wall 77 of the drum to receive the male hinge end 97 of the end slat 5A of the door 3. The depression 95 extends across the width of the drum. The depression has an overhang 99 on one side 101 to help retain the end 97 of the slat within the depression. The overhang 99 and the side 101 of the depression are shaped to form part of the female hinge end 103 of a slat so as to snugly receive part of the male hinge end 97. The overhang 99 forms part of a flat section 105 of the wall 77 of the drum that extends generally tangentially away from the depression 95. The flat section 105 is wide enough to receive about half of the width of the panel portion 107 of the end slat 5A. The weight of the door hanging down the one side of the drum pulls the male end 97 of the end slat 5A tight into the depression 95, the male end 97 held in place by the overhang 99. The end slat 5A extends generally tangentially away from the depression 95 with the female hinge end 103 positioned relatively close to the wall 77 of the drum. The door is easily mounted on the drum by merely sliding the male hinge end 97 into the depression under the overhang 99.

The wall 77 of the drum leaving the flat section 105 follows a spiral curve moving gradually radially away from the center of the drum as it returns to the other side of the depression 95. The gradual enlarging of the drum around its periphery allows the hinged door 3 to be smoothly wound about the drum.

I Claim:

1. A hollow drum for a roll-up closure, the closure having a door of hinged-together slats, each slat having a male hinge along one long side of the slat and a female hinge along the other long side of the slat, the upper end of the door adapted to be mounted on the drum with the male hinge on the slat on the upper end of the door, the door adapted to be wound on the drum as the drum is rotated; the drum having an outer wall with a shallow depression in the wall extending inwardly and across the width of the drum parallel to the axis of rotation of the drum; the wall, seen in cross-section, generally defining a partial spiral portion extending from at least near one side of the depression to the other side of the depression with the radius of the wall at least near the one side of the depression being the shortest radius of the wall and the radius of the wall adjacent the other side of the depression being the longest radius of the wall, the wall having a short wall extension extending from the outer edge of the one side of the depression toward the other side of the depression, the short wall extension alone partially closing the depression; the one side of the depression under the wall extension, curved to at least partially match the curvature of the female hinge member on the other side of the slats, the one side of the depression and the wall extension shaped to snugly, rotatably, receive a male hinge member on the one side of the slats wherein a short portion of the wall of the drum extends tangentially away from the one side of the depression to merge with the partial, spiral portion of the wall;

and wherein the wall extension is aligned with the short, tangential portion of the wall; the short, tangential portion of the wall a distance away from the center of the drum at the one side of the depression that is longer than the shortest radius of the wall.

* * * * *